US011058934B2

(12) United States Patent
Goodwin et al.

(10) Patent No.: US 11,058,934 B2
(45) Date of Patent: Jul. 13, 2021

(54) BALL BAT WITH CANTILEVERED INSERT

(71) Applicant: Wilson Sporting Goods Co., Chicago, IL (US)

(72) Inventors: Ty B. Goodwin, Vancouver, WA (US); Sean S. Epling, Portland, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 16/390,671

(22) Filed: Apr. 22, 2019

(65) Prior Publication Data

US 2020/0330838 A1 Oct. 22, 2020

(51) Int. Cl.
*A63B 59/56* (2015.01)
*A63B 59/54* (2015.01)

(52) U.S. Cl.
CPC ..... *A63B 59/56* (2015.10); *A63B 59/54* (2015.10)

(58) Field of Classification Search
CPC ..... A63B 59/36; A63B 59/54; A63B 59/50
See application file for complete search history.

(56) References Cited

U.S. PATENT DOCUMENTS 3,116,926 A 1/1964 Owen et al.
3,392,976 A 7/1968 Hayes
4,274,631 A 6/1981 Hayazaki
4,898,386 A 2/1990 Anderson
4,951,948 A 8/1990 Peng
5,080,363 A 1/1992 Soong
5,219,164 A 6/1993 Peng
5,303,917 A 4/1994 Uke
5,415,398 A * 5/1995 Eggiman ..... A63B 59/51 473/566
5,511,777 A 4/1996 McNeely
5,899,823 A 5/1999 Eggiman
5,964,673 A 10/1999 MacKay, Jr.
6,053,827 A 4/2000 MacKay, Jr. et al.
6,077,178 A 6/2000 Brandt
6,497,631 B1 12/2002 Fritzke et al.
6,530,852 B2 3/2003 Rios
6,733,404 B2 5/2004 Fritzke et al.
6,767,299 B1 7/2004 Chang
6,783,471 B2 8/2004 Bolduc et al.
6,808,464 B1 * 10/2004 Nguyen ..... A63B 59/50 473/566
6,875,137 B2 4/2005 Forsythe et al.
6,905,429 B2 6/2005 Forsythe et al.
6,949,038 B2 9/2005 Fritzke
7,011,588 B2 3/2006 Fritzke et al.
7,044,871 B2 5/2006 Sutherland et al.
(Continued)

*Primary Examiner* — Steven B Wong
(74) *Attorney, Agent, or Firm* — Terence P. O'Brien; Todd A. Rathe

(57) ABSTRACT

A ball bat, extending along a longitudinal axis and configured for impacting a ball, may include a handle portion, an end cap, a barrel and a tubular insert. The barrel longitudinally extends along the longitudinal axis between the handle portion and the end cap. The barrel has a distal end and an inner surface, a portion of which proximate the distal end forms an insert mounting portion. The tubular insert may have a cantilevered portion having an outer surface separated from the inner surface. The cantilevered portion is cantilevered from the insert mounting portion independent of the end cap and forms a majority of a length of the tubular insert.

15 Claims, 8 Drawing Sheets

(56) References Cited

U.S. PATENT DOCUMENTS

| | | | | |
|---|---|---|---|---|
| 7,052,419 | B2 | 5/2006 | Chang | |
| 7,140,988 | B1 | 11/2006 | Hinman | |
| 7,166,046 | B1 | 1/2007 | Liu | |
| 7,175,552 | B2 | 2/2007 | Fritzke et al. | |
| 7,201,679 | B2 | 4/2007 | Nguyen | |
| 7,267,619 | B1 | 9/2007 | Pettis | |
| 7,399,242 | B1 | 7/2008 | Smith | |
| 7,572,197 | B2 | 8/2009 | Chauvin et al. | |
| 7,601,083 | B1 | 10/2009 | Heald et al. | |
| 7,749,115 | B1 | 7/2010 | Cruz et al. | |
| 7,867,114 | B2 * | 1/2011 | Sutherland | A63B 59/50 473/567 |
| 7,955,200 | B1 | 6/2011 | Cruz et al. | |
| 7,980,970 | B2 | 7/2011 | Watari et al. | |
| 8,206,250 | B1 | 6/2012 | Cruz et al. | |
| 8,226,505 | B2 | 7/2012 | Burger | |
| 8,317,640 | B1 | 11/2012 | Cruz et al. | |
| 8,512,176 | B1 | 8/2013 | Mathew et al. | |
| 8,632,428 | B2 | 1/2014 | Burger | |
| 9,005,056 | B2 | 4/2015 | Pegnatori | |
| 9,067,109 | B2 * | 6/2015 | Epling | A63B 60/08 |
| 9,149,697 | B2 | 10/2015 | Epling et al. | |
| 9,242,155 | B1 | 1/2016 | Lindsay et al. | |
| 9,242,156 | B2 | 1/2016 | Goodwin et al. | |
| 9,731,180 | B2 | 8/2017 | Goodwin et al. | |
| 10,220,277 | B1 * | 3/2019 | Hunt | A63B 59/51 |
| 2002/0091022 | A1 * | 7/2002 | Fritzke | A63B 59/51 473/566 |
| 2002/0094892 | A1 * | 7/2002 | Chauvin | A63B 59/50 473/566 |
| 2003/0013563 | A1 | 1/2003 | Ryan | |
| 2004/0043846 | A1 | 3/2004 | Haynes | |
| 2005/0070384 | A1 | 3/2005 | Fitzgerald et al. | |
| 2005/0143203 | A1 | 6/2005 | Souders et al. | |
| 2006/0252586 | A1 | 11/2006 | Nguyen | |
| 2007/0142135 | A1 | 6/2007 | Cheng | |
| 2007/0155546 | A1 | 7/2007 | Chauvin et al. | |
| 2008/0234076 | A1 * | 9/2008 | Bhatt | A63B 59/50 473/566 |
| 2009/0280934 | A1 * | 11/2009 | Watari | A63B 59/50 473/566 |
| 2009/0280935 | A1 * | 11/2009 | Watari | A63B 59/56 473/566 |
| 2010/0029418 | A1 * | 2/2010 | Chen | A63B 59/50 473/564 |
| 2010/0125014 | A1 * | 5/2010 | Watari | A63B 59/54 473/566 |
| 2011/0111892 | A1 * | 5/2011 | Thouin | A63B 60/10 473/520 |
| 2011/0111894 | A1 | 5/2011 | Thouin | |
| 2011/0152015 | A1 * | 6/2011 | Burger | A63B 59/50 473/520 |
| 2011/0172038 | A1 | 7/2011 | Watari et al. | |
| 2014/0206483 | A1 | 7/2014 | Goodwin et al. | |
| 2014/0274491 | A1 | 9/2014 | Long et al. | |
| 2014/0274492 | A1 | 9/2014 | Kennedy | |
| 2014/0274493 | A1 | 9/2014 | Heussner | |
| 2015/0273295 | A1 | 10/2015 | Haas et al. | |
| 2017/0340935 | A1 | 11/2017 | Gray et al. | |
| 2018/0093148 | A1 * | 4/2018 | Tsukamoto | A63B 59/56 |

* cited by examiner

BALL BAT WITH CANTILEVERED INSERT

BACKGROUND

Ball bats are well-known sporting goods. Such baseball and softball bats are regulated in their size, weight and dimensions.

Figure 1:
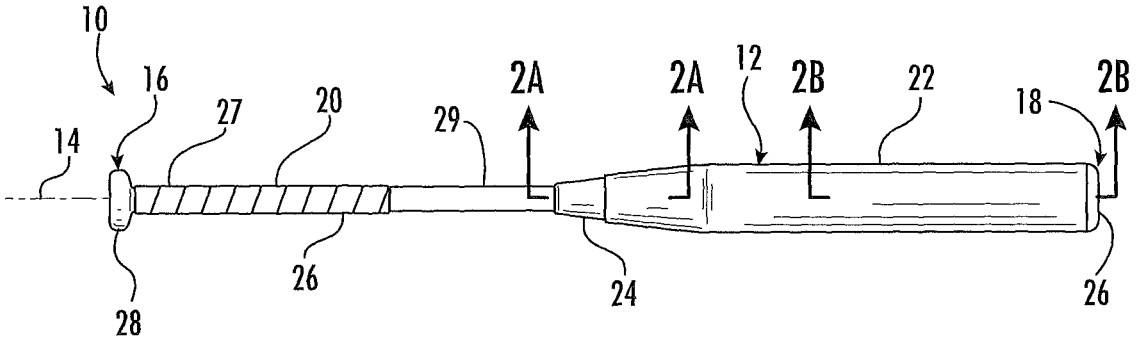
FIG. 1 is a side view of an example ball bat.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed is an example ball bat that has improved performance and that may be more economically constructed. Disclosed is an example ball bat that cantilevers a tubular insert within a barrel of the ball bat such that deflection of the barrel results in the barrel contacting the tubular insert. The tubular insert comprises a cantilevered portion that forms a majority of the total length of the tubular insert and is cantilevered from an insert mounting portion of the barrel. An entirety of the cantilevered portion is suspended within the barrel by the insert mounting portion of the barrel. The insert mounting portion is located proximate to a distal end of the barrel such that a majority of the total length of the tubular insert is cantilevered and spaced from the inner surface of the barrel absent deflection of the barrel such as during impact with a ball. The cantilevered portion has a proximal end that is unaffixed or is suspended within the barrel so as to be movable relative to the barrel.

In some implementations, the cantilevered portion is radially spaced from the barrel by a separation. In one implementation, the separation has a thickness of at least 0.002 inches and no greater than 0.250 inches. In one implementation, the separation has a thickness of at least 0.005 inches and no greater than 0.080 inches.

The tubular insert may include a spacing interface that connects the tubular insert to the insert mounting portion of the barrel independent of the end cap. The spacing interface is radially located between the outer surface of the cantilevered portion of the tubular insert and the inner surface of the barrel. In one implementation, the outer surface of the cantilevered portion has a first outer diameter and the tubular insert further comprises a barrel mounting portion integrally formed as part of a single unitary body with the cantilevered portion. The barrel mounting portion has an outer surface having a second diameter greater than the first outer diameter so as to form the spacing interface. In one implementation, the barrel mounting portion comprises a portion of the tubular insert that is outwardly deformed. In another implementation, the barrel mounting portion comprises a portion of the tubular insert that is molded so as to have a bell-shape.

In other implementations, the spacing interface may comprise a ring extending between the tubular insert and the insert mounting portion. In one implementation, the ring is affixed to the insert mounting portion by at least one of adhesive, serrations, threads, an interference fit or combinations thereof. In some implementations, the ring is affixed to the tubular insert by at least one of adhesive, serrations, threads, an interference fit or combinations thereof. In some implementations, the ring or other form a spacing interface may be molded over the tubular insert. In yet another implementation, the spacing interface consists of an adhesive layer over the tubular insert, wherein the thickness of the adhesive layer spaces the inner surface of the barrel from the outer surface of the cantilevered portion.

In some implementations, the barrel comprises a first shoulder along the inner surface and wherein the tubular insert comprises a second shoulder opposing the first shoulder. The shoulders may serve to locate and actually retain the insert within the barrel.

In some implementations, the barrel comprises a central impact region extending from the insert mounting portion to a proximal end of the barrel and wherein the cantilevered portion extends along an entire length of the central impact region. In one implementation, the cantilevered portion extends at least 70% of a length of the barrel. In one implementation, the insert mounting portion is spaced from the distal end of the barrel by no greater than 20% of the length of the tubular insert.

In some implementations, the tubular insert has a uniform thickness along an entirety of a length of the tubular insert. In other implementations, tubular insert may have a varying thickness along the length of the tubular insert. In one implementation, the barrel and the tubular insert are each formed from a fiber composite material. In other implementations, the barrel and the tubular insert may be formed from other materials.

Disclosed herein is an example ball bat that may include a handle portion, an end cap, a barrel and a tubular insert. The barrel longitudinally extends along an axis between the handle portion and the end cap. The barrel has a distal end and an inner surface, a portion of which proximate the distal end forms an insert mounting portion. The tubular insert may have a cantilevered portion having an outer surface separated from the inner surface. The cantilevered portion is cantilevered from the insert mounting portion independent of the end cap and forms a majority of a length of the tubular insert.

FIG. 1 illustrates a ball bat is generally indicated at 10. The ball bat 10 of FIG. 1 is configured as a baseball bat; however, the ball bat 10 can also be formed as a fastpitch softball bat, a slow pitch softball bat, a rubber ball bat, or other form of ball bat. The bat 10 includes a tubular frame 12 extending along a longitudinal axis 14 from a proximal end 16 to a distal end 18. For purposes of this disclosure, a "proximal end" of any structure is that portion of the structure that is closest to the proximal end 16, whereas a "distal end" of any structure that portion of the structure that is closest to distal end 18. The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel 18 can range from 1.5 to 3.5 inches.

Figure 2A:
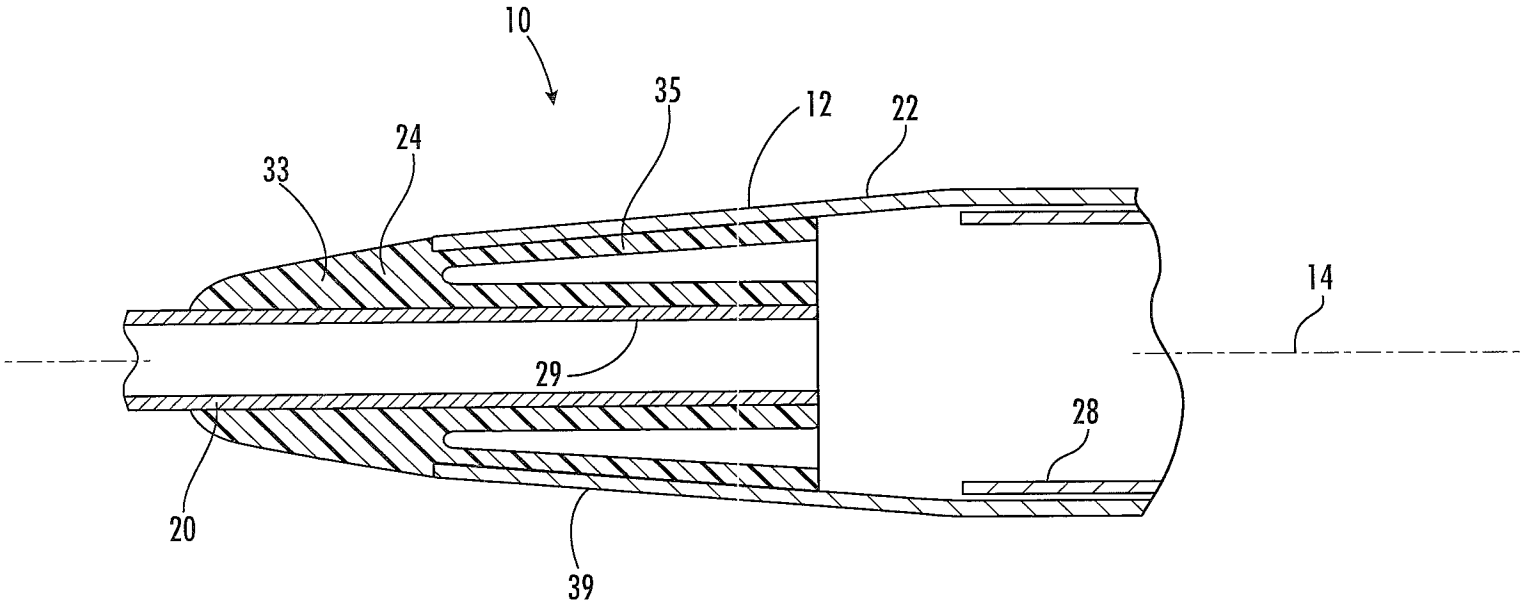
FIG. 2A is a sectional view of the ball bat of FIG. 1 taken along line 2A-2A of FIG. 1.
Figure 2B:
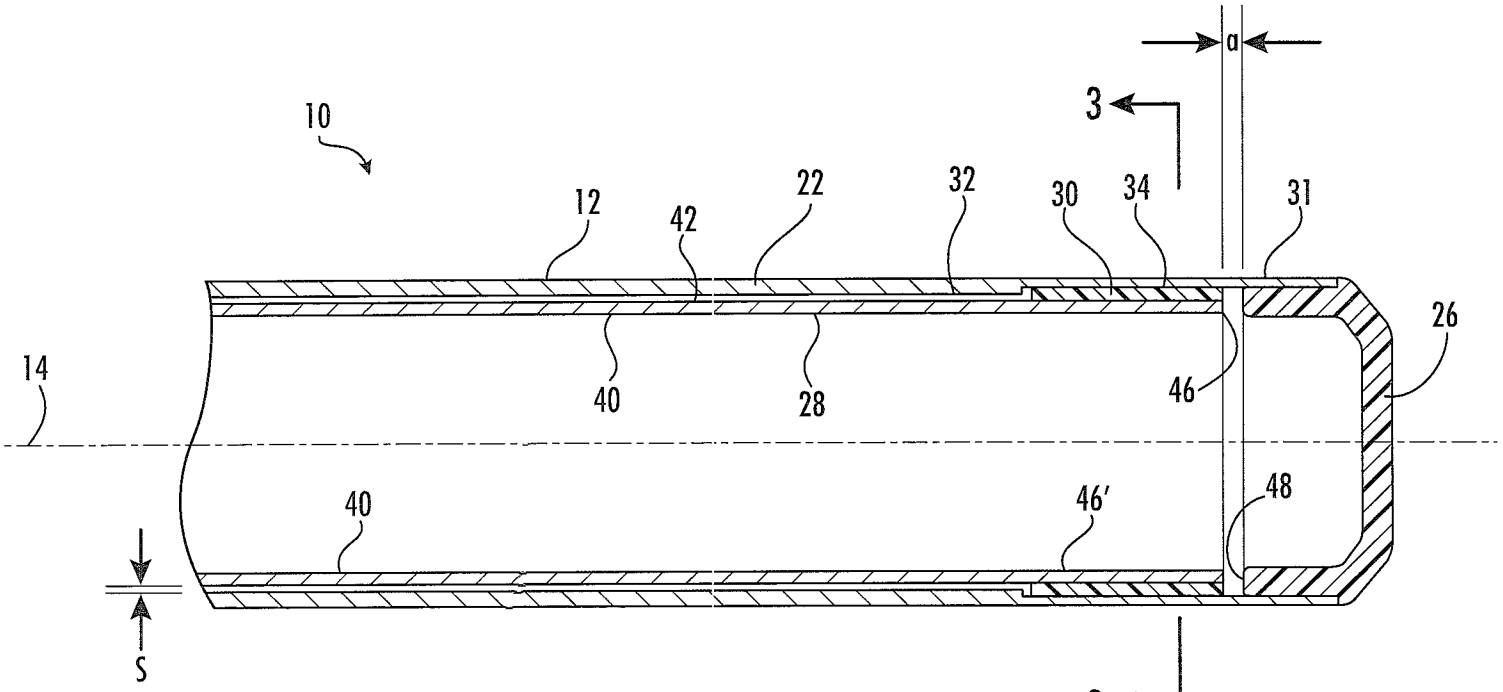
FIG. 2B is a sectional view of the ball bat of FIG. 1 taken along line 2B-2B of FIG. 1.

The frame 12 comprises a relatively small diameter handle portion 20, a relatively larger diameter barrel 22, an intermediate tapered element 24, end cap 26, a tubular insert 28 (shown in FIGS. 2A and 2B) and a spacing interface 30 (schematically shown in FIG. 2B). In one implementation, the handle portion 20, barrel portion 22 and the intermediate tapered element 24 can be formed as separate structures, which are connected or coupled together. This multi-piece frame construction enables each of the three components to be formed of different materials or similar materials to match a particular player need or application. In another implementation, the frame can be a one piece integral structure that includes the handle portion that tapers outward to the barrel. In another implementation, the multi-piece frame can include a handle portion having distal end region that.

Handle portion 20 is an elongate tubular structure that extends along the axis 14. The handle portion 20 includes a proximal end region 27 and a distal end region 29. The handle portion 20 is sized for gripping by the user and includes a grip 26, which is wrapped around and extends longitudinally along the handle portion 20, and a knob 28 is connected to the proximal end region 27 of the handle portion 20. The distal end region 29 can be connected to the element 24 that couples the handle portion 20 to the barrel 22. The handle portion 20 is preferably a cylindrical structure having a uniform outer diameter along its length. The handle portion 20 can also have a uniform inner diameter along its length. In alternative implementations, the handle portion can be formed with a distal end region that outwardly extends to form a frustoconical shape or tapered shape.

The handle portion 20 is formed of a strong, generally flexible, lightweight material, preferably a fiber composite material. Alternatively, the handle portion 20 can be formed of other materials such as an aluminum alloy, a titanium alloy, steel, other alloys, a thermoplastic material, a thermoset material, wood or combinations thereof. In other alternative embodiments, the handle can have slightly tapered or non-cylindrical shapes.

As used herein, the terms "composite material" or "fiber composite material" refer to a plurality of fibers impregnated (or permeated throughout) with a resin. In one example embodiment, the fibers can be systematically aligned through the use of one or more creels, and drawn through a die with a resin to produce a pultrusion, as discussed further below. In an alternative example embodiment, the fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly example implementations, the number layers can range from 3 to 8. In other implementations, the number of layers can be greater than 8. In multiple layer constructions, the fibers can be aligned in different directions (or angles) with respect to the longitudinal axis 14 including 0 degrees, 90 degrees and angular positions between 0 to 90 degrees, and/or in braids or weaves from layer to layer. For composite materials formed in a pultrusion process, the angles can range from 0 to 90 degrees. In some implementations, the layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of example embodiments, the resin is preferably a thermosetting resin such as epoxy or polyester resins. In other sets of example embodiments, the resin can be a thermoplastic resin. The composite material is typically wrapped about a mandrel and/or a comparable structure (or drawn through a die in pultrusion), and cured under heat and/or pressure. While curing, the resin is configured to flow and fully disperse and impregnate the matrix of fibers.

The tapered element 24 is a transitional member that connects the handle portion 20 to the barrel 22. In one implementation, the element 20 includes a tapered proximal region 33 and a barrel engaging region 35 that engages a proximal region 39 of the barrel 22. In particularly preferred embodiments, the barrel engaging region 35 can also be tapered similar to the proximal region 39 such that the element 24 has a frustoconical shape.

The element 24 can be formed of one or more lightweight, tough, durable materials, such as engineered thermoplastic polyurethane (ETPU). Alternatively, the element 24 can be formed of other materials, such as thermoplastic materials, thermoset materials, a composite material, a fiber composite material, aluminum, an alloy, wood, and combinations thereof. The element 24 can significantly reduce the level of undesirable vibrational and shock energy extending from the barrel 22 to the handle portion 20 upon impact with a ball 50.

The barrel 22 of the frame 12 is "tubular," "generally tubular," or "substantially tubular," each of these terms is intended to encompass softball style bats having a substantially cylindrical impact (or "barrel") portion as well as baseball style bats having barrels with generally frusto-conical characteristics in some locations. Alternatively, other hollow, tubular shapes can also be used. Accordingly, portions of the barrel 22 may have a generally continuous circular tubular shape along its length, and in other portions, the barrel 22 may taper inward or outward forming frusto-conical shapes and/or missile type shapes. The barrel 22 is configured for impacting the ball 50, and preferably is formed of a strong, durable and resilient material, such as, a fiber composite material or an aluminum alloy. In alternative example embodiments, the barrel 22 may be formed of one or more composite materials, a titanium alloy, a scandium alloy, steel, other alloys, a thermoplastic material, a thermoset material, wood or combinations thereof.

In the implementation of FIG. 1, the bat 10 includes a multi-piece bat frame 12 that includes the handle portion 20, the barrel 22 and the element 24 connecting the barrel 22 to the handle portion 20. In another implementation, the handle portion may be integrally formed to the barrel such that the bat frame 12 is one continuous structure. In another implementation, the handle portion 20 may include an outwardly projecting distal region that generally resembles a trumpet type shape and the proximal region of the barrel can include an inwardly extending tapered region that corresponds to the distal region of the handle portion so as to provide a mechanical lock between the distal region of the handle portion and the proximal region of the barrel. The distal region of the handle portion can be directed connected to the proximal region of the barrel or the distal region of the handle portion can be coupled to the proximal region of the barrel by one or more layers of material.

End cap 26 is attached to a distal end 31 of the barrel 22 to substantially enclose the distal end of the barrel 22. In one example embodiment, the end cap 26 is bonded to the distal end 31 of barrel 22 through an epoxy. Alternatively, the end cap 26 may be coupled to the distal end 31 of barrel 22 through other adhesives, chemical bonding, thermal bonding, an interference fit, other press-fit connections and combinations thereof.

As shown by FIGS. 2A and 2B barrel 22 has an inner surface 32, a portion of which proximate the distal end 31 forms an insert mounting portion 34. As further shown by FIGS. 2A and 2B, tubular insert 28 comprises an elongate tubular structure within barrel 22. Tubular insert 28 may be formed of a strong, durable and resilient material, such as, a fiber composite material or an aluminum alloy. In alternative example embodiments, the barrel 22 may be formed of one or more composite materials, a titanium alloy, a scandium alloy, steel, other alloys, a thermoplastic material, a thermoset material, wood or combinations thereof.

Tubular insert 28 has a cantilevered portion 40 having an outer surface 42 radially spaced from or separated from inner surface 32 by a separation S. In one implementation, the outer surface 42 of cantilevered portion 40 is radially spaced from the inner surface 32 of barrel 22 by separation S have a thickness of at least 0.002 inches and no greater than 0.250 inches. Upon impact with the ball 50, the barrel 22 can deflect inward and momentarily close the separation S such that the inner surface 32 of the barrel 22 operably engages or contacts the outer surface 42 of the cantilevered portion 40 at the impact location. The engagement or contact between barrel 22 and insert 28 provides additional support to the barrel 22 which can enhance the durability of barrel 22 and prevent premature denting or plastic deformation of the barrel 22. The engagement between the barrel 22 and cantilevered portion 40 can allow for independent movement between the barrel 22 and the cantilevered portion creating a leaf spring effect that can enhance the performance of the bat 10. The engagement of the barrel 22 and the insert 28 can also enhance the feel and/or audible sound of the bat 10 when impacting the ball 50. In one implementation, the separation S has a thickness of at least 0.002 inches and no greater than 0.250 inches. In another implementation, the separation S has a thickness of at least 0.005 inches and no greater than 0.080 inches. In one implementation, the separation S may be uniform along the entire length of cantilevered portion 40. In other implementations, the separation S may vary along the length of cantilevered portion 40. In one implementation, the above-indicated ranges of separations S is satisfied along the entire length of cantilevered portion 28. In another implementation, the above-indicated ranges of separation S are satisfied along a majority of the length of cantilevered portion 28. In yet another implementation, barrel 22 may have a preferred impact region, wherein portions of the inner surface 32 of barrel 22 in the preferred impact region are separated from the outer surface 42 of cantilevered portion 40 by the above-indicated range for the separation S, while other portions of inner surface 32 of barrel 22 outside of the preferred impact region may be separated from outer surface 42 of cantilevered portion 40 by other separation thicknesses or distances.

As further shown by FIGS. 2A and 2B, cantilevered portion 40 is cantilevered from the insert mounting portion 34 of the barrel 22 independent of end cap 26 and forms a majority of the total or overall length of tubular insert 28. In one implementation, the cantilevered portion 40 extends over at least 60 percent of the total or overall length of the barrel portion. In another implementation, the cantilevered portion 40 extends over at least 70 percent of the total or overall length of the barrel portion. In another implementation, the cantilevered portion 40 has a length measured along the longitudinal axis 14 of at least 7 inches. In other implementations, the cantilevered portion 40 has a length measured along the longitudinal axis 14 of at least 8 inches. In other implementations, the length of the cantilevered portion 40 can be other lengths such as least 9 inches, at least 10 inches and at least 12 inches. As a result, proximal end of tubular insert 28 is unaffixed or floating, along the proximal end of tubular insert 28 and is configured to deflect, pivot or bend from the portion of the tubular insert 28 at the insert mounting portion 34 which is in close proximity to the distal end 31 of barrel 22. In one implementation, the insert mounting portion 34 of barrel 22 is spaced from or extends from the distal end 31 of barrel 22 by the distance of no greater than 20% of the length of tubular insert 28.

Because cantilevered portion 40 is cantilevered from the portion of the tubular insert 28 at the insert mounting portion 34 independent of end cap 26, end cap 26 may be simpler, omitting structures for supporting tubular insert 28. In addition, ball bat 10 may omit at least portions of the total amount of adhesive that would otherwise be required to adhere tubular insert 28 to end cap 26. As a result, ball bat 10 may be lighter because less adhesive, such as an epoxy adhesive or a two-part urethane adhesive are required to secure the end cap 26 to the distal end 31 of the barrel 22.

The weight saving from having to use less adhesive can be used in other locations or components of the bat to optimize a particular bat's balance, swing weight and/or performance.

In the example illustrated, tubular insert 28 has a distal end 46 that is longitudinally or axially spaced from an interior surface 48 of end cap 26. In one implementation, the distal end 46 is longitudinally spaced from the end cap 26 by a dimension, a, of at least 0.005 inches and no greater than 0.5 inches. Such spacing facilitates the pivoting or movement of cantilevered portion 40 without relying upon end cap 26 for support. In other implementations, distal end 46 may abut the interior surface 48 of end cap 26 while remaining unattached to end cap 26, such that the dimension a may be zero. As shown by broken lines, in some implementations, tubular insert 28 may have an alternative distal end 46'which extends just beyond cantilevered portion 40 and which is coupled to a spacing interface 30.

Spacing interface 30 (schematically shown) mounts and secures the tubular insert 28 to the insert mounting portion 34 of inner surface 32 of barrel 22. Spacing interface 30 at least partially provides the radial spacing between surfaces 42 and 32 that provides separation S. In one implementation, the outer surface 42 of cantilevered portion 40 has a first outer diameter, wherein the tubular insert 28 further comprises a barrel mounting portion integrally formed as part of a single unitary body with the cantilevered portion 40, wherein the barrel mounting portion has an outer surface having a second outer diameter greater than the first outer diameter just to form the spacing interface 30. The outer surface of the mounting portion is radially opposite to insert mounting portion 34 and is directly or indirectly secured to the insert mounting portion 34 of barrel 22. The outer surface of the mounting portion may be secured to the insert mounting portion 34 by at least one of adhesives, serrations, helical threads, an interference fit or combinations thereof.

In another implementation, spacing interface 30 is formed by a ring extending radially between the tubular insert 28 (portions of tubular insert 28 other than cantilevered portion 40) and insert mounting portion 34 of barrel 22. The ring may have a thickness corresponding to the separation S or may, in combination with any adhesives thereon provide separation S. The ring may be combined with multiple overlapping rings to provide the separation S. In such an implementation, the exterior of the ring or the outermost ring of a collection of rings may be affixed to the insert mounting portion 34 of barrel 22 by at least one of adhesive, serrations, threads, an interference fit or combinations thereof. Likewise, the interior of the ring or the interior of the innermost ring of a collection of rings may be affixed to the outer surface of the tubular insert 28 by at least one of adhesive, serrations, threads, an interference fit or combinations thereof. In yet other implementations, spacing interface 30 may comprise a ring or a structure molded over, bowed or on tubular insert 28, where the molding has a greater thickness in regions of tubular insert 28 opposite to insert mounting portion 34 as compared to other regions of tubular insert 28, such as cantilevered portion 40.

Figure 3:
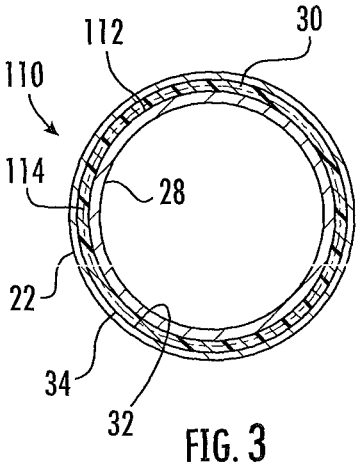
FIG. 3 is a cross-sectional view of the ball bat of FIG. 2 taken along line 3-3.
Figure 4:
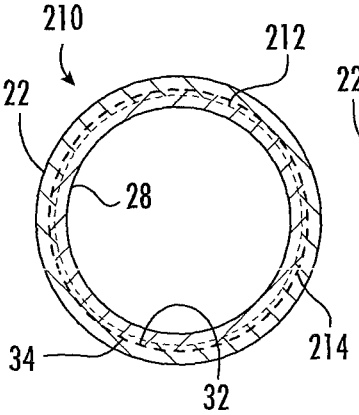
FIG. 4 is a cross-sectional view of another example ball bat taken along line 3-3 of FIG. 2.
Figure 5:
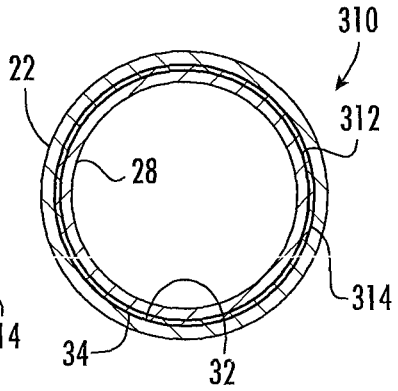
FIG. 5 is a cross-sectional view of another example ball bat taken along line 3-3 of FIG. 2.

FIGS. 3, 4 and 5 illustrate various ball bat's and various alternatives for securing spacing interface 30, in the form of a ring, between tubular insert 28 and insert mounting portion 30 of barrel 22. Each of the ball bat shown in FIGS. 3-5 are similar to ball bat 10 in all respects except that each is specifically illustrated as having a spacing interface 30 in the form of a ring which is secured in a particular fashion. FIG. 3 illustrates portions of ball bat 110, wherein spacing interface 30, in the form of a ring, is secured about tubular interface 28 by a first press-fit 112 and where spacing interface 30 is further secured to the insert mounting portion 34 of surface 32 of barrel 22 by press-fit 114.

FIG. 4 illustrates portions of ball bat 210, wherein spacing interface 30, in the form of a ring, is secured about tubular interface 28 by grooves, serrations or helical threads 212 (schematically illustrated by dash-dash lines) and where spacing interface 30 is further secured to the insert mounting portion 34 of surface 32 of barrel 22 by grooves, serrations or helical threads 214 (also schematically illustrated by dash-dash lines). The serrations provide a roughened surface or high friction surface to facilitate such securement. In implementations where helical threads are employed, the ring may be screwed onto insert 28 and/or into barrel 22.

FIG. 5 illustrates portions of ball bat 310, wherein spacing interface 30, in the form of a ring, is secured about tubular interface 28 by adhesive 312 (schematically illustrated by thick solid lines) and where spacing interface 30 is further secured to the insert mounting portion 34 of surface 32 of barrel 22 by adhesive 314 (also schematically illustrated by thick solid lines). The adhesives 312 and 314 may assist in providing the separation S. In one implementation, the adhesives may comprise an epoxy. In other implementations, other adhesives may be utilized.

Figure 6:
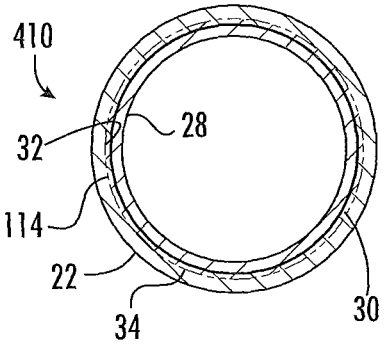
FIG. 6 is a cross-sectional view of another example ball bat taken along line 3-3 of FIG. 2.
Figure 7:
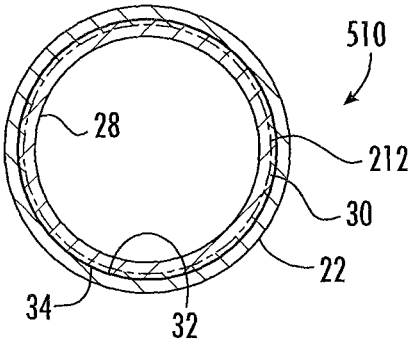
FIG. 7 is a cross-sectional view of another example ball bat taken along line 3-3 of FIG. 2.

FIGS. 6 and 7 are sectional views illustrating portions of bats where the spacing interface 30 is integrally formed as part of a single unitary body with tubular insert 28 and barrel 22, respectively. FIG. 6 illustrates ball bat 410 where tubular insert 28 has a distal end portion outwardly deformed, bent, molded or otherwise provided so as to have a larger diameter barrel mounting portion serving as the spacing interface 30. In the example illustrated, the outer surface of the larger diameter barrel mounting portion serving as spacing interface 30 is press-fit (as schematically indicated by dot-dot-dash lines 114) to and against those portions of inner surface 32 forming insert mounting portion 34 of barrel 22. In other implementations, the outer surface of the barrel mounting portion of the tubular insert 28 may be secured to those portions of inner surface 32 forming insert mounting portion 34 of barrel 22 by a high friction surface, such as serrations or helical threads 214 or by adhesives 314 as described above with respect to FIGS. 4 and 5, respectively.

FIG. 7 illustrates ball bat 510 where interior portions of barrel 22 are removed (such as by drilling) or are molded such that particular portions of barrel 22 have a smaller inner diameter as compared to the remaining portions of barrel 22 that extend opposite to cantilevered portion 40, wherein the particular portions form spacing interface 30. In the example illustrated, the inner surface of the smaller diameter portion of barrel 22 serving as spacing interface 30 is press-fit (as schematically indicated by dot-dot-dash lines 212) to and against the outer surface of tubular insert 28. In other implementations, the smaller diameter inner surface of the distal end portion of barrel 22 forming the spacing interface 30 may be secured to the outer surface of tubular insert 28 by a high friction surface, such as serrations or helical threads 212 or by adhesives 312 as described above with respect to FIGS. 4 and 5, respectively.

Figure 8:
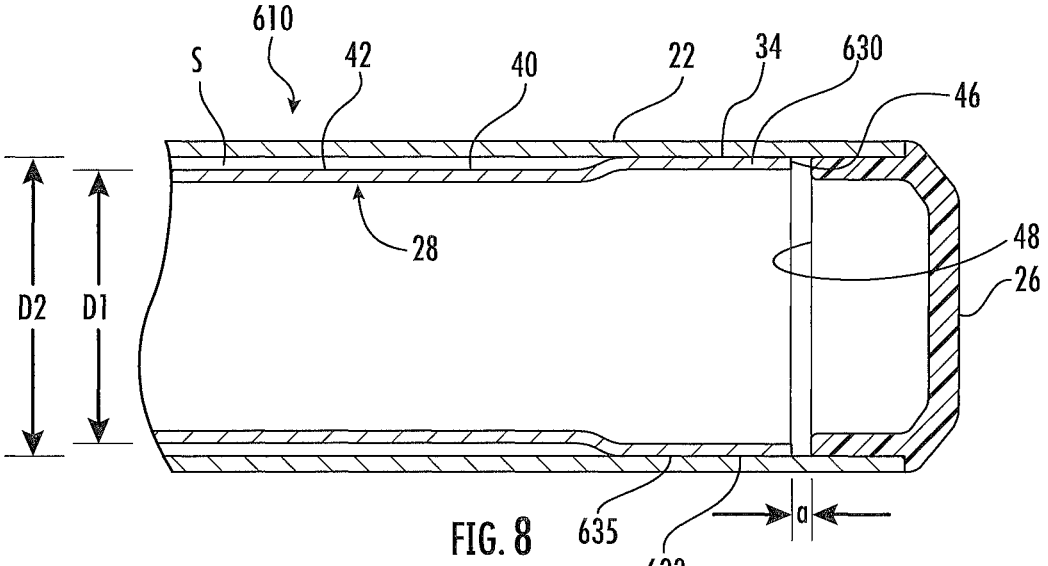
FIG. 8 is a sectional view of another example ball bat taken along line 2B-2B of FIG. 1.

FIG. 8 is a sectional view of portions of an example ball bat 610 taken along line 2B-2B of FIG. 1. Ball bat 610 is similar to ball bat 10 described above except that ball bat 610 is specifically illustrated as comprising spacing interface 630. Those remaining components of ball bat 610 which correspond to components of ball bat 10 are numbered similarly or are shown in FIG. 1.

As shown by FIG. 8, the outer surface 42 of cantilevered portion 40 of the tubular insert 28 has a first outer diameter D1, wherein the tubular insert 28 further comprises a barrel mounting portion 633, serving as the spacing interface 630. Barrel mounting portion 633 is integrally formed as part of a single unitary body with the cantilevered portion 40, wherein the barrel mounting portion 633 has an outer surface 635 having a second outer diameter D2 greater than the first outer diameter D1, wherein the separation S is D2-D1. Accordingly, the tubular insert 28 of FIG. 8 is one continuous structure with a distal end region, the barrel mounting portion 633, that has a larger diameter than the cantilevered portion 40. The wall thickness of the tubular insert 28 of FIG. 8 is generally constant or has only minimal variation along its length. FIG. 8 shows one transition from the cantilevered portion 40 to the barrel mounting portion 633. In other implementations, the transition can occur over a longer longitudinal distance or a shorter longitudinal distance. The outer surface of the mounting portion is radially opposite to insert mounting portion 34 and is directly or indirectly secured to the insert mounting portion 34 of barrel 22. The outer surface 635 of the mounting portion 633 may be secured to the insert mounting portion 34 by at least one of adhesives, serrations, helical threads, an interference fit or combinations thereof. In one implementation, barrel mounting portion 633 is formed through material deformation or bending of the distal end portions of tubular insert 28. In another implementation, barrel mounting portion 633 is molded so as to have a greater outer diameter as compared to the outer diameter of cantilevered portion 40. The barrel mounting portion 633 is the only portion or region of the tubular insert 28 that engages or connects to the barrel 22. The remaining portion of the tubular insert 28 is the cantilevered portion 40.

The barrel mounting portion 633 of the tubular insert 28 has the distal end 46 that is longitudinally or axially spaced from the interior surface 48 of the end cap 26. In one implementation, the distal end 46 is longitudinally spaced from the end cap 26 by a dimension, a, of at least 0.005 inches. In another implementation, the dimension a is at least 0.005 inch and no greater than 0.5 inches. In other implementations, the distal end 46 may abut the interior surface 48 of end cap 26 while remaining unattached to end cap 26, such that the dimension a may be zero.

Similar to the embodiment of FIGS. 2A and 2B above, the cantilevered portion 40 of FIG. 8 is cantilevered from the barrel mounting portion 633 of the tubular insert 28 independent of end cap 26. The cantilevered portion 40 forms a majority of the total or overall length of barrel 22. In one implementation, the cantilevered portion 40 extends over at least 60 percent of the total or overall length of the barrel 22. In another implementation, the cantilevered portion 40 extends over at least 70 percent of the total or overall length of the barrel 22. In another implementation, the cantilevered portion 40 forms a majority of the total or overall length of tubular insert 28. In one implementation, the cantilevered portion 40 extends over at least 60 percent of the total or overall length of the tubular insert 28. In another implementation, the cantilevered portion 40 extends over at least 70 percent of the total or overall length of the tubular insert 28. In another implementation, the cantilevered portion 40 has a length measured along the longitudinal axis 14 of at least 7 inches. In other implementations, the cantilevered portion 40 has a length measured along the longitudinal axis 14 of at least 8 inches. In other implementations, the length of the cantilevered portion 40 can be other lengths such as least 9 inches, at least 10 inches and at least 12 inches. As a result, proximal end of the cantilevered portion 40 of the tubular insert 28 is unaffixed or floating, along the proximal end of tubular insert 28. The proximal end of the cantilevered portion 40 is configured to deflect, pivot or bend with respect to the barrel mounting portion 633 which is in close proximity to the distal end 31 of barrel 22 upon impact of the barrel 22 with the ball 50 (FIG. 1) at or near the proximal end of the cantilevered portion 40. The barrel 22 is configured to inwardly deflect at the impact location with the ball 50, which on some impacts can be sufficient enough to operably engage the cantilevered portion 40 of the tubular insert 28 can cause the cantilevered portion 40 to move independently of the barrel 22.

In one implementation, barrel 22 and the tubular insert 28 are both formed of a fiber composite material. The tubular insert 28 can be produced using bladder molding. A clamshell two piece mold is shaped to produce the tubular insert 28 with the barrel mounting portion 633. A bladder is placed into an uncured composite layup positioned within the mold. The mold is closed, the bladder is pressurized, and the tubular insert 28 is formed under heat and pressure. The tubular insert 28 is then removed from the mold and allowed to cure.

Figure 9:
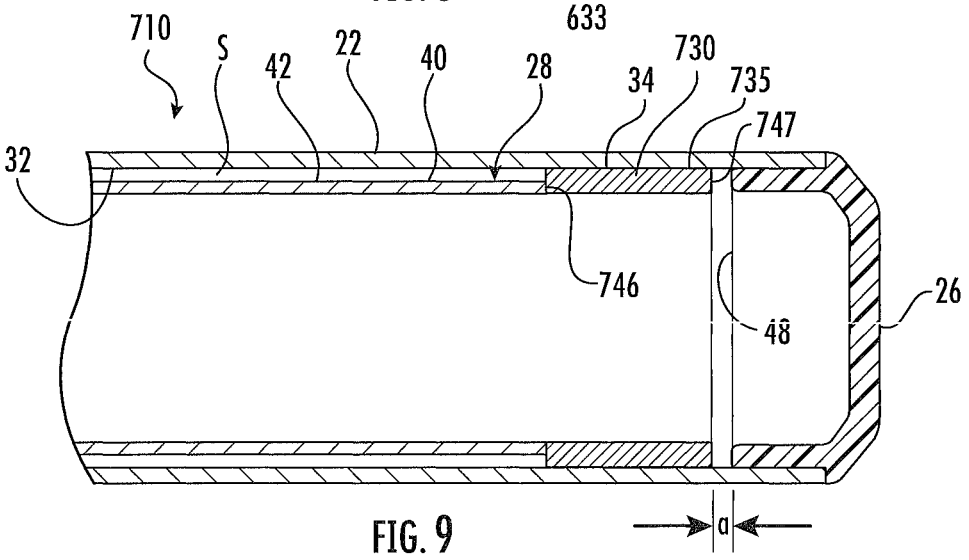
FIG. 9 is a sectional view of another example ball bat taken along line 2B-2B of FIG. 1.

FIG. 9 is a sectional view of portions of an example ball bat 710 taken along line 2B-2B of FIG. 1. Ball bat 710 is similar to ball bat 10 described above except that ball bat 710 is specifically illustrated as comprising spacing interface 730. Those remaining components of ball bat 710 which correspond to components of ball bat 10 are numbered similarly or are shown in FIG. 1.

Spacing interface 730 comprises a ring affixed to an axial distal end 746 of tubular insert 28, wherein the ring (or spacing insert 730) has an outer surface secured to insert mounting portion 34 of barrel 22. The ring forming the spacing interface 730 has a thickness so as to space surface 42 of cantilevered portion 40 of the tubular insert 28 from interior surface 32 by the spacing S. The ring forming spacing interface 730 has an axial end 747 that is longitudinally spaced from end cap 26. The spacing interface 730 supports cantilevered portion 40 independent of end cap 26. The outer surface 735 of the spacing interface 730 is radially opposite to insert mounting portion 34 and is directly or indirectly (such as with intervening adhesive) secured to the insert mounting portion 34 of barrel 22. The outer surface 735 of the spacing interface 730 may be secured to the insert mounting portion 34 by at least one of adhesives, serrations, helical threads, an interference fit or combinations thereof.

Figure 10:
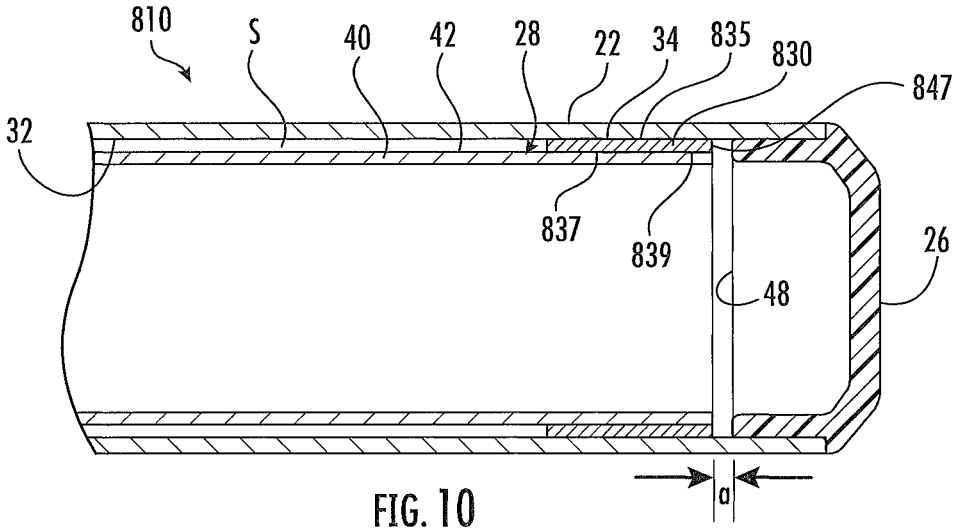
FIG. 10 is a sectional view of another example ball bat taken along line 2B-2B of FIG. 1.

FIG. 10 is a sectional view of portions of an example ball bat 810 taken along line 2B-2B of FIG. 1. Ball bat 810 is similar to ball bat 10 described above except that ball bat 810 is specifically illustrated as comprising a spacing interface 830. Those remaining components of ball bat 810 which correspond to components of ball bat 10 are numbered similarly or are shown in FIG. 1.

Spacing interface 830 comprises a ring secured between insert mounting portion 34 of barrel 22 and an exterior surface of a distal region of the tubular insert 28. The ring forming spacing interface 830 has a thickness so as to space surface 42 of cantilevered portion 40 from interior surface 32 by the spacing S. The ring forming spacing interface 830 has an axial distal end 847 that is longitudinally spaced from end cap 26. In one implementation, the axial distal end 847 is longitudinally spaced from the end cap 26 by a dimension, a, of at least 0.005 inches and no greater than 0.5 inches. In other implementations, the axial distal end 847 may abut the interior surface 48 of end cap 26 while remaining unattached to end cap 26, such that the dimension a may be zero.

The spacing interface 830 supports cantilevered portion 40 independent of end cap 26. In one implementation, the outer surface 835 of the spacing interface 830 is radially opposite to insert mounting portion 34 and is directly or indirectly (such as with intervening adhesive) secured to the insert mounting portion 34 of barrel 22. The outer surface 835 of the spacing interface 830 may be secured to the insert mounting portion 34 by at least one of adhesives, serrations, helical threads, an interference fit or combinations thereof. The inner surface 837 of the ring forming the spacing interface 830 may be secured to the outer surface 839 of tubular insert 28 (those outer surface portions that are not part of cantilevered portion 40) by at least one of adhesives, serrations, helical threads, an interference fit or combinations thereof. In one implementation, the spacing interface 830 is formed of a thermoplastic material that is overmolded to a distal region of the tubular insert 28. In one implementation, the ring may be first mounted to tubular insert 28 and then inserted into barrel 22. In another implementation, the ring may be first secured to the interior surface of barrel 22, wherein insert 28 is then inserted through or into the ring.

In the embodiment of FIG. 10, the tubular insert 28 can be formed as more of a uniform diameter tube, and the spacing interface 830, or barrel engaging portion, is formed over the outer surface of the distal region of the tubular insert 28. In this manner, the tubular insert does not have to be molded or otherwise formed to have the outerwardly projecting distal region to form the barrel engaging portion. Rather, the distal end region receives the overmolding layer, or spacing interface 830, that increases the thickness of the distal region of the tubular insert and the spacing interface 830 provides the means for mounting or coupling the tubular insert 28 to the insert mounting portion 34 of the barrel 22.

Figure 11:
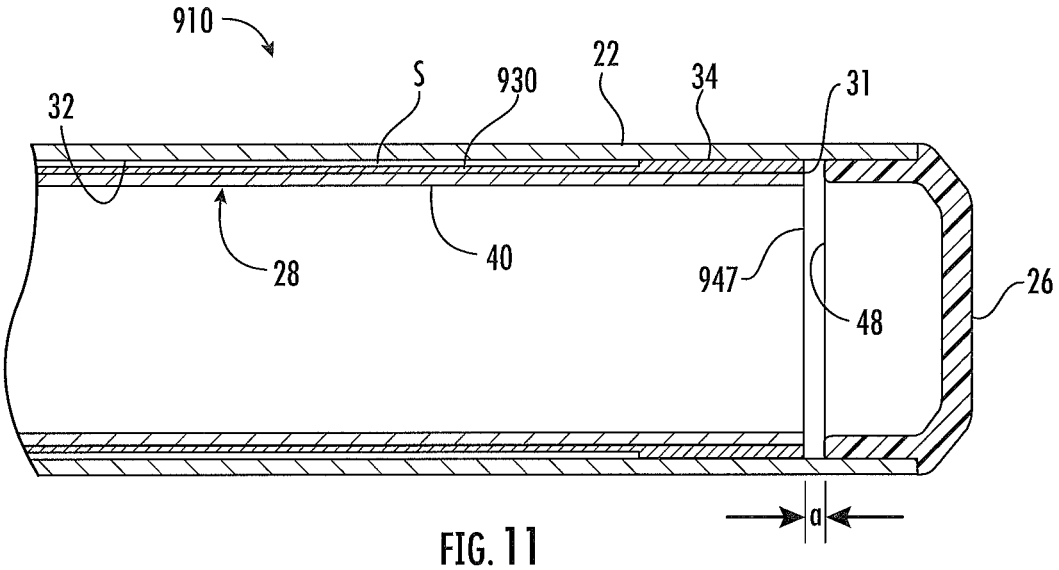
FIG. 11 is a sectional view of another example ball bat taken along line 2B-2B of FIG. 1.

FIG. 11 is a sectional view of portions of an example ball bat 910 taken along line 2B-2B of FIG. 1. Ball bat 910 is similar to ball bat 10 described above except that ball bat 910 is specifically illustrated as comprising spacing interface 930. Those remaining components of ball bat 910 which correspond to components of ball bat 10 are numbered similarly or are shown in FIG. 1.

Spacing interface 930 comprises at least one layer of material formed upon or molded on and exterior surface of tubular insert 28. The at least one of material has a reduced thickness or is not present in regions about cantilevered portion 40 wall having a thickness or a greater thickness in those portions of insert 28 that extend radially opposite to insert mounting portion 34 of barrel 22. The increased thickness in the particular regions of insert mounting portion 34 space surface 42 of cantilevered portion 40 from interior surface 32 by the spacing S. The at least one layer of material supports cantilevered portion 40 independent of end cap 26. In one implementation, the axial distal end 947 is longitudinally spaced from the end cap 26 by a dimension, a, of at least 0.010 inches and no greater than 0.5 inches. In other implementations, the axial distal end 947 may abut the interior surface 48 of end cap 26 while remaining unattached to end cap 26, such that the dimension a may be zero. In one implementation, those thicker portions of the layer of material may be press-fit with respect to insert mounting portion 34 of barrel 22. In yet another implementation, the at least one layer of material may be molded or injected in between insert 28 and barrel 22, while insert 28 is inserted within barrel 22, wherein the liquid or molted material bonds tubular insert 28 to barrel 22.

Figure 12:
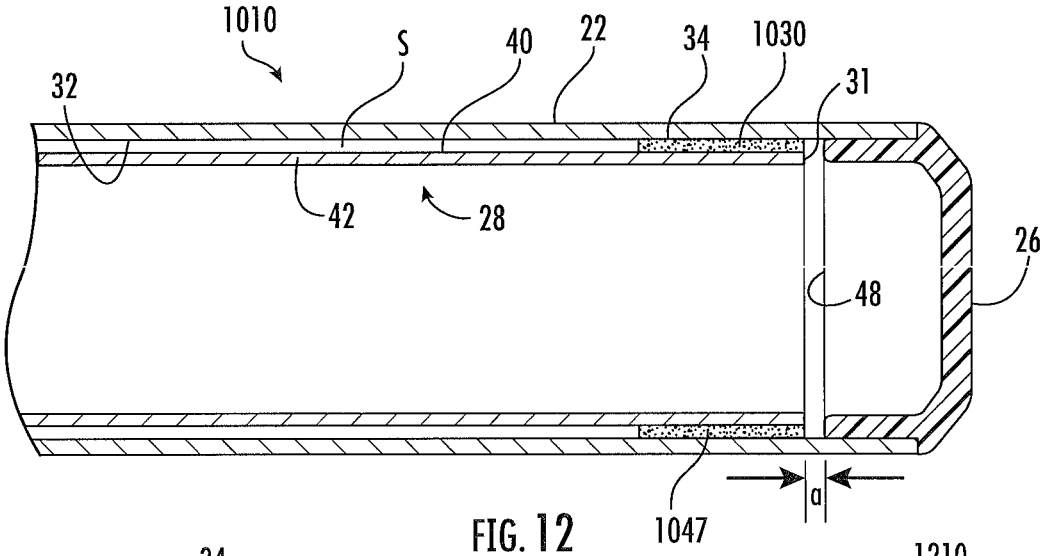
FIG. 12 is a sectional view of another example ball bat taken along line 2B-2B of FIG. 1.

FIG. 12 is a sectional view of portions of an example ball bat 1010 taken along line 2B-2B of FIG. 1. Ball bat 1010 is similar to ball bat 10 described above except that ball bat 1010 is specifically illustrated as comprising spacing interface 1030. Those remaining components of ball bat 1010 which correspond to components of ball bat 10 are numbered similarly or are shown in FIG. 1.

Spacing interface 1030 consists of adhesive, applied as one or more layers, to the selected portions of exterior surface of tubular insert 28, namely to those portions directly opposite to insert mounting portion 34 of barrel 22. The remaining exterior portions of tubular insert 28 may have a lesser thickness of adhesive or may omit adhesive. The increased thickness in the particular regions of insert mounting portion 34 space surface 42 of cantilevered portion 40 from interior surface 32 by the spacing S. The adhesive layer(s) supports cantilevered portion 40 independent of end cap 26. In one implementation, the axial distal end 1047 is longitudinally spaced from the end cap 26 by a dimension, a, of at least 0.010 inches and no greater than 0.5 inches. In other implementations, the axial distal end 1047 may abut the interior surface 48 of end cap 26 while remaining unattached to end cap 26, such that the dimension a may be zero. In one implementation, the adhesive comprises an epoxy, a two-part urethane adhesive, or other form of adhesive, which is allowed to harden, solidify and/or cure while tubular insert portion 28 is temporarily supported in a neutral position, generally centered within the interior of barrel 22.

Figure 13:
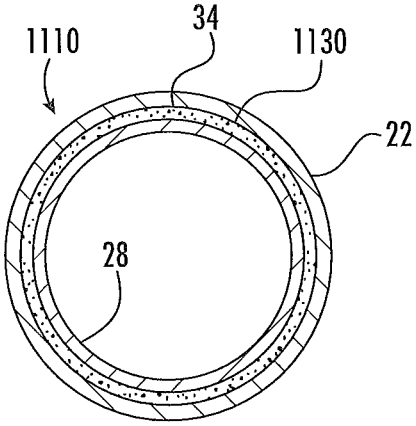
FIG. 13 is a cross-sectional view of another example ball bat taken along line 3-3 of FIG. 2.

FIG. 13 is a sectional view of portions of an example ball bat 1110 taken along line 3-3 of FIG. 2. Ball bat 1110 is similar to ball bat 10 described above except that ball bat 1110 is specifically illustrated as having spacing interface 1130 that completely encircles tubular insert 28 adjacent to and opposite to insert mounting portion 34 of barrel 22. In some implementations, rather than a continuous ring that continuously and axially extends across an opposite to the entirety of insert mounting portion 34, spacing interface 1130 may comprise multiple longitudinally or axially spaced rings directly opposite to insert mounting portion 34 of barrel 22. In the example illustrated, spacing interface 1130 may comprise any of the implementations of spacing interfaces described above such as spacing interface 30, spacing interface 630, spacing interface 730, spacing interface 830, spacing interface 930 or spacing interface 1030. Spacing interface may be secured to barrel 22 and or tubular insert 28 (where spacing interface is not integrally formed as part of a unitary body with barrel 22 or insert 28) by at least one of a press-fit, serrations, threads, adhesive or combinations thereof.

Figure 14:
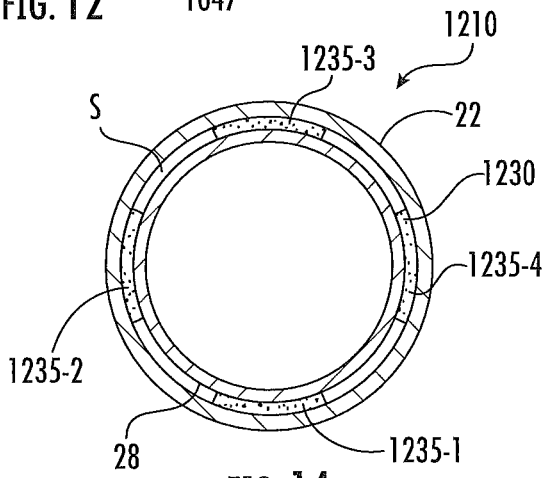
FIG. 14 is a cross-sectional view of another example ball bat taken along line 3-3 of FIG. 2.

FIG. 14 is a sectional view of portions of an example ball bat 1210 taken along line 3-3 of FIG. 2. Ball bat 1210 is similar to ball bat 10 and 1110 described above except that ball bat 1210 is specifically illustrated as having spacing interface 1230. Unlike spacing interface 1130, spacing interface 1230 comprises multiple radially-spaced segments 1235-1, 1235-2, 1235-3 and 1235-4 (collectively referred to as segments 1235) angularly spaced about tubular insert 28 between tubular insert 28 and insert mounting portion 34 of barrel 22. In the example illustrated, spacing interface 1230 comprises four segments angularly spaced 90°, on center, apart from one another. In other implementations, spacing interface 1230 may comprise 2 segments spaced 180°, on center, apart from one another, three segments spaced 120°, on center, apart from one another, or even a larger number of such equidistantly spaced segments. Such segments may be affixed to barrel 22 or tube 28 by at least one of a press-fit, serrations or threads, or an adhesive. As with the above described spacing inserts, spacing insert 1230 cantilevers cantilevered portion 40 from the distal end of barrel 22, independent of end cap 26, of providing the spacing S between the outer surface 42 of cantilevered portion 40 and the inner surface 32 of barrel 22.

Figure 15:
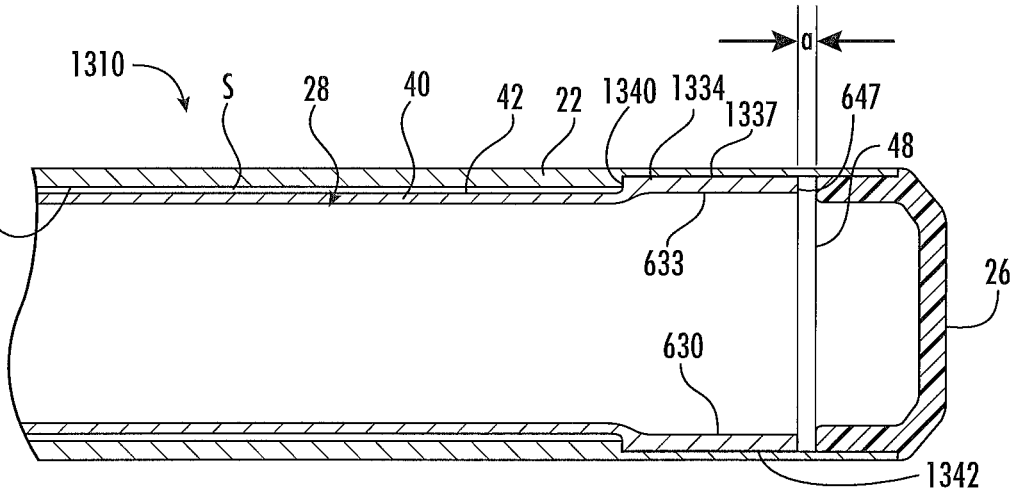
FIG. 15 is a sectional view of another example ball bat taken along line 2B-2B of FIG. 1.

FIG. 15 is a sectional view of portions of an example ball bat 1310 taken along line 2B-2B of FIG. 1. Ball bat 1310 is similar to ball bat 610 described above except that barrel 22 comprises an insert mounting portion 1334 in place of insert mounting portion 34. The remaining portions of ball bat 1310 which correspond to portions of ball bat 610 are numbered similarly or are shown in FIG. 1.

Insert mounting portion 1334 is similar to insert mounting portion 34 except that insert mounting portion 1334 has an interior annular recess 1337 providing mounting portion 1334 with a larger inner diameter as compared to those portions of inner surface 32 opposite to cantilevered portion 40 of tubular insert 28. The interior annular recess 1337 receives spacing interface 630 and forms and annular shoulder 1340 which faces end cap 26. The shoulder 1340 can form a locating surface against which a shoulder of the barrel mounting portion 633 of insert 28 may abut to axially locate insert 28 within barrel 22 and to assist in axially retaining insert 28 within barrel 22. In the example illustrated, the barrel mounting portion 633 may be secured to the floor or inner surface 1342 of recess 1337 by at least one of a press-fit, serrations or threads, or an adhesive. The annular recess 1337 can be formed by a machining step that roughens the inner surface of the barrel at the insert mounting portion 1334 to facilitate the engagement of the barrel mounting portion 633 and the insert mounting portion 1334. As shown by FIG. 15, the outer diameter of barrel mounting portion 633 of tubular insert 28 is sufficiently larger than the outer diameter of cantilevered portion 40 such that surface 42 of cantilevered portion 40 is spaced from inner surface 32 by spacing S (described above). In other implementations, the transition to from the inner surface 32 of the barrel 22 to the interior annular recess 1337 can be tapered or more gradual such that the shoulder 1340 is replaced by a tapered surface.

The barrel mounting portion 633 of the tubular insert 28 has the distal end 46 that is longitudinally or axially spaced from the interior surface 48 of the end cap 26. In one implementation, the distal end 647 is longitudinally spaced from the end cap 26 by a dimension, a, of at least 0.010 inches and no greater than 0.5 inches. In other implementations, the distal end 647 may abut the interior surface 48 of end cap 26 while remaining unattached to end cap 26, such that the dimension a may be zero.

Similar to the embodiment of FIGS. 2A and 2B above, the cantilevered portion 40 of FIG. 8 is cantilevered from the barrel mounting portion 633 of the tubular insert 28 independent of end cap 26. The cantilevered portion 40 forms a majority of the total or overall length of barrel 22. In one implementation, the cantilevered portion 40 extends over at least 60 percent of the total or overall length of the barrel 22. In another implementation, the cantilevered portion 40 extends over at least 70 percent of the total or overall length of the barrel 22. In another implementation, the cantilevered portion 40 forms a majority of the total or overall length of tubular insert 28. In one implementation, the cantilevered portion 40 extends over at least 60 percent of the total or overall length of the tubular insert 28. In another implementation, the cantilevered portion 40 extends over at least 70 percent of the total or overall length of the tubular insert 28. In another implementation, the cantilevered portion 40 has a length measured along the longitudinal axis 14 of at least 7 inches. In other implementations, the cantilevered portion 40 has a length measured along the longitudinal axis 14 of at least 8 inches. In other implementations, the length of the cantilevered portion 40 can be other lengths such as least 9 inches, at least 10 inches and at least 12 inches. As a result, proximal end of the cantilevered portion 40 of the tubular insert 28 is unaffixed or floating, along the proximal end of tubular insert 28. Similar to the example ball bat of FIG. 8, the barrel mounting portion 633 of the ball bat of FIG. 15 is the only portion or region of the tubular insert 28 that engages or connects to the barrel 22. The remaining portion of the tubular insert 28 is the cantilevered portion 40.

In one implementation, the distal region of the fiber composite barrel 22 is machined to form the interior annular recess 1337, a step within the inner diameter of the distal region of the barrel 22. The machined step or annular recess 1337 can have a depth of approximately 0.005 to 0.010 inch. In other implementations, the depth of the recess can be within the range of 0.002 to 0.030 inch. The machining of the step or annular recess 1337 also ensures a uniform surface and surface texture on the distal region of the barrel 22 for providing the best surface for interference fit with the barrel mounting portion 633.

Figure 16:
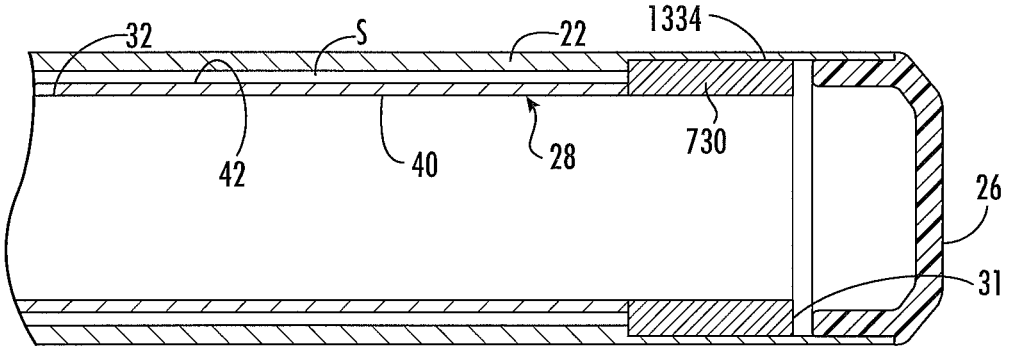
FIG. 16 is a sectional view of another example ball bat taken along line 2B-2B of FIG. 1.
Figure 17:
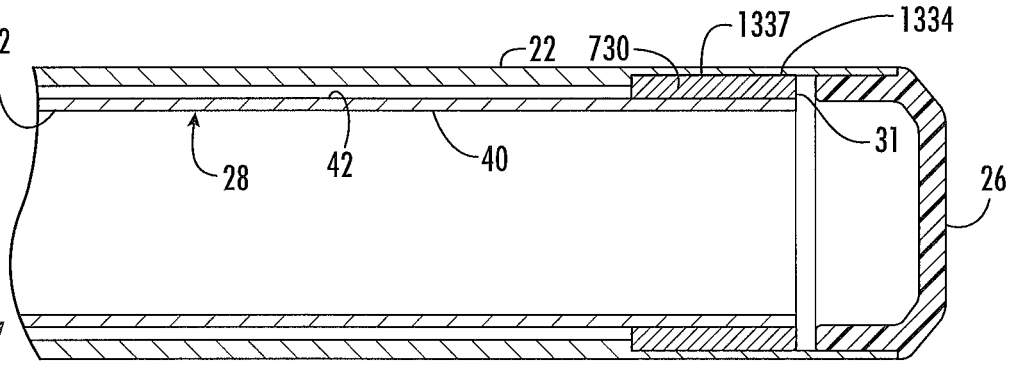
FIG. 17 is a sectional view of another example ball bat taken along line 2B-2B of FIG. 1.

FIGS. 16 and 17 illustrate variations of ball bat 1310, wherein such ball bats include different spacing interfaces in place of spacing interface 630. FIG. 16 is a sectional view of portions of an example ball bat 1410 take along line 2B-2B of FIG. 1. Ball bat 1410 is similar to ball bat 710 described above except that ball bat 1410 comprises insert mounting portion 1334 which receives a portion of spacing interface 730 (described above with respect to ball bat 710). Those components of ball bat 1410 which correspond to components of ball bat 710 and 1310 are numbered similarly or are shown in FIG. 1. In some implementations, spacing insert 730 may have a greater thickness when utilized with insert mounting portion 1334 to provide sufficient spacing S (described above) between surface 42 of cantilevered portion 40 and interior surface 32 of barrel 22.

FIG. 17 is a sectional view of portions of an example ball bat 1510 take along line 2-2 of FIG. 1. Ball bat 1510 is similar to ball bat 810 described above except that ball bat 1510 comprises insert mounting portion 1334 which receives a portion of spacing interface 830 (described above with respect to ball bat 810). Those components of ball bat 1510 which correspond to components of ball bat 810 and 1310 are numbered similarly or are shown in FIG. 1. In some implementations, spacing insert 830 may have a greater thickness when utilized with insert mounting portion 1334 to provide sufficient spacing S (described above) between surface 42 of cantilevered portion 40 and interior surface 32 of barrel 22.

Figure 18:
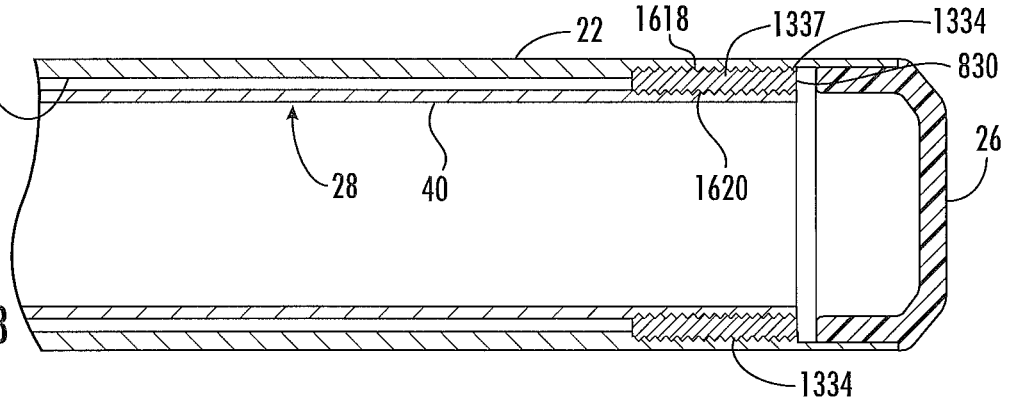
FIG. 18 is a sectional view of another example ball bat taken along line 2B-2B of FIG. 1.

FIG. 18 is a sectional view of portions of an example ball bat 1610 take along line 2-2 of FIG. 1. Ball bat 1610 is similar to ball bat 810 described above except that spacing interface 830 of ball bat 1610 is specifically illustrated as being screwed into engagement with insert mounting portion 1334 of barrel 22 by helical thread 1618 and is also being screwed onto exterior portions of tubular insert 28 at distal end portions of tubular insert 28 by helical threads 1620. In some implementations, spacing insert 830 may have a greater thickness when utilized with insert mounting portion 1334 to provide sufficient spacing S (described above) between surface 42 of cantilevered portion 40 and interior surface 32 of barrel 22.

Figure 19:
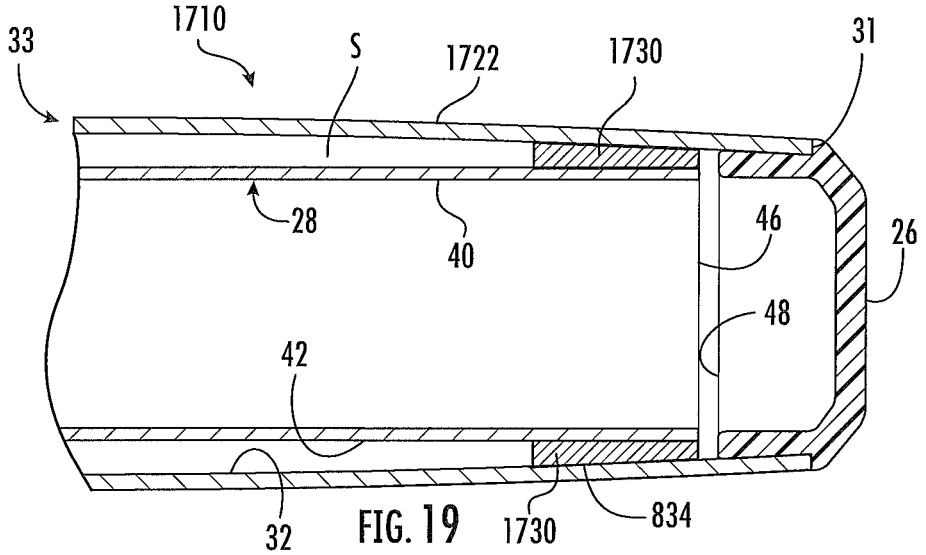
FIG. 19 is a sectional view of another example ball bat taken along line 2B-2B of FIG. 1.

FIG. 19 is a sectional view of portions of an example ball bat 1710 take along line 2B-2B of FIG. 1. Ball bat 1710 is similar to ball bat 810 described above except that bat 1710 has a barrel 1722 in place of barrel 22 has and spacing insert 1730 in place of spacing insert 830. Those remaining components are portions of ball bat 1710 which correspond to components of ball bat 10 and ball bat 810 are numbered similarly or are shown in FIG. 1.

Barrel 1722 is similar to barrel 22 except that barrel 1722 has a more varying inner diameter and a varying outer diameter along its axial or longitudinal length. In the example illustrated, barrel 1722 inwardly tapers proximate its distal end 31 to accommodate the outer diameter of end cap 26. Barrel 1722 has a widening outer diameter and a widening inner diameter and central regions, generally at a midpoint of barrel 1722, which form a hitting zone or sweet spot of barrel 1722. Barrel 1722 once again tapers at its proximal end 33 such that its outer surface or outer diameter is more closely aligned with the outer surface of tapered element 24 (shown in FIG. 1).

In other implementations, barrel 1722 may have other profiles. For example, in other implementations, barrel 1722 may have an outer diameter and an inner diameter that continuously widen from the proximal ends 33 to the distal end 31. In some implementations, barrel 1722 may have a nonuniform thickness along its length. In some implementations, barrel 1722 may have a uniform inner diameter but a nonuniform outer diameter along its axial length. In still other implementations, barrel 1722 may have a uniform outer diameter but a nonuniform inner diameter along its axial length. In other implementations, the outer surface of the tubular insert 28 can have variable surface, or the tubular insert 28 can have a variable wall thickness. The outer surface of the tubular insert 28 may form one or more regions of projections and/or recesses. The projections and/or recesses may extend longitudinally along the tubular insert 28 or may extend in a direction that is transverse to a longitudinal axis of the bat 1710. In other implementations, the shape of one or more projections and/or recesses can be random or varied so as to extend at one or more angles with respect to longitudinal axis of the bat 1710. Accordingly, the separation S can vary in size along the length of the tubular insert 28 as it extends within the barrel 22 or with respect to the inner surface of the barrel 22.

Spacing interface 1730 is similar to spacing interface 810 except that spacing interface 1730 also has a varying outer diameter longs axial length to accommodate the varying inner diameter of barrel 1722. In the example illustrated, spacing interface 1730, in insert mounting portion 834, is wedge-shaped, having a larger outer diameter at its proximal end and a smaller outer diameter at its distal end. In other implementations where the inner diameter of barrel 1722 widens as it approaches distal end 31, spacing interface 1730 may likewise have a smaller outer diameter at its proximal end and a wider outer diameter at its distal end.

As with spacing interface 830 described above, spacing interface 830 may comprise a ring secured to tubular insert 28 and the insert mounting portion 834 of inner surface 32 of barrel 1722. The ring may be secured by at least one of a press-fit, serrations, helical threads, adhesives or combinations thereof. In other implementations, spacing interface 830 may alternatively have a configuration similar to spacing interface, 630, 730, 930 or 1030 as described above. In some implementations, barrel 1722 may additionally comprise an inner annular groove 1334 forming a shoulder 1340 (as illustrated and described above with respect to FIGS. 15-18), wherein the shoulder 1340 abuts spacing interface 1730 to axially locate and retain spacing interface 1730. In some implementations.

As with each and every spacing insert described above, spacing insert 1730 connects the tubular insert 28 to the insert mounting portion of the barrel 22, 1722 independent of the end cap 26. As with each and every spacing insert described above, spacing insert 1730 provides the separation S having a thickness of at least 0.002 inches and no greater than 0.125 inches. In some implementations, the separation has a thickness of at least 0.010 inches and no greater than 0.030 inches. As with each and every spacing insert described above, spacing insert 1730 spaces the cantilevered portion 40 of tubular insert 28 such that the cantilevered portion 40 comprises a majority of the total length of tubular insert 28. In some implementations, cantilevered portion 40 extends along an entire length of the central impact region of the barrel. In one implementation, the cantilevered portion extends at least 70% of a length of the barrel. In each of the above described implementations, the insert mounting portion may, in some instances, be spaced from the distal end of the barrel by no greater than 20% of the length of the tubular insert. As with each and every spacing insert described above, the spacing insert 830 may continuously encircle or surround the tubular insert as described above with respect to ball bat 1110 or may comprise multiple angularly spaced segments as described above with respect to ball bat 1210.

Figure 20:
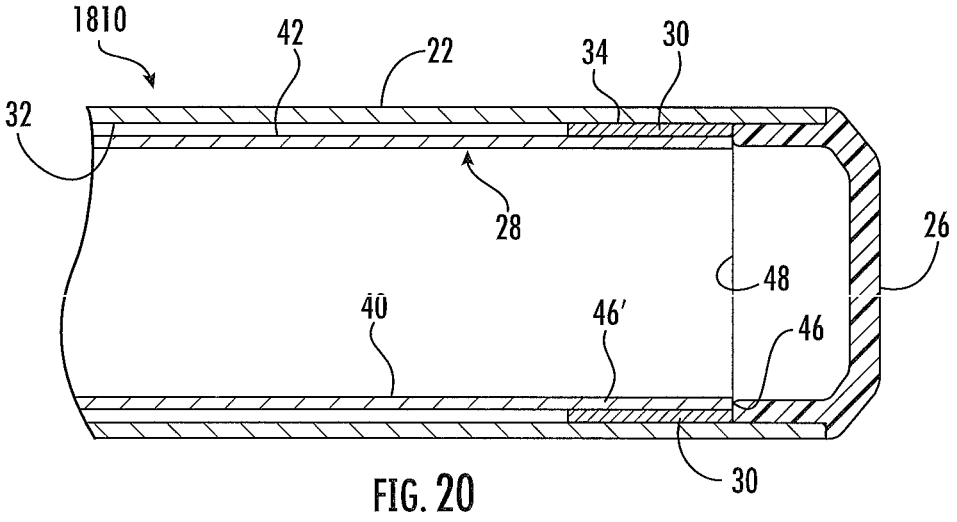
FIG. 20 is a sectional view of another example ball bat taken along line 2B-2B of FIG. 1.
Figure 21:
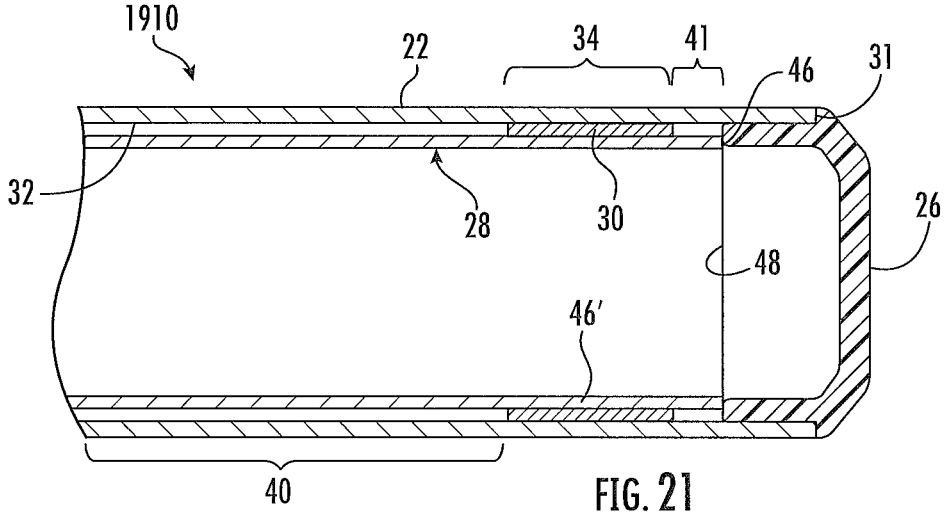
FIG. 21 is a sectional view of another example ball bat taken along line 2B-2B of FIG. 1.

FIGS. 20 and 21 illustrate variations in the location of the tubular insert and spacing interface with respect to end cap 26. FIG. 20 illustrates portions of an example ball bat 1810. Ball bat 1810 is similar to ball bat 10 described above except that in ball bat 1810, at least one of tubular insert 28 and spacing interface 30 abut an interior surface 48 of end cap 26. In such implementations, end cap 26 does not support tubular insert 28. Adhesive is not placed between and in contact with end cap 26 and insert 28 or between and in contact with spacing interface 30 and end cap 26.

FIG. 21 illustrates portions of an example ball bat 1910. Ball bat 1910 is similar to ball bat 10 described above except that in ball bat 1910, tubular insert 28 projects beyond spacing insert 30 towards the end cap 26. This may result in a relatively small distal end portion 41 of tubular insert 28 also being cantilevered from spacing insert 30. However, spacing insert 30 is sized and is located relative to barrel 22 and tubular insert 28 such that the proximal cantilevered portion 28 still comprises a majority of the overall length of tubular insert 28. In such an implementation, the cantilevered portion 40 still extends at least 70% of a length of the barrel 22. In such implementations, the insert mounting portion 34 may, in some instances, still be spaced from the distal end of the barrel by no greater than 20% of the total length of the tubular insert 28.

Figure 22:
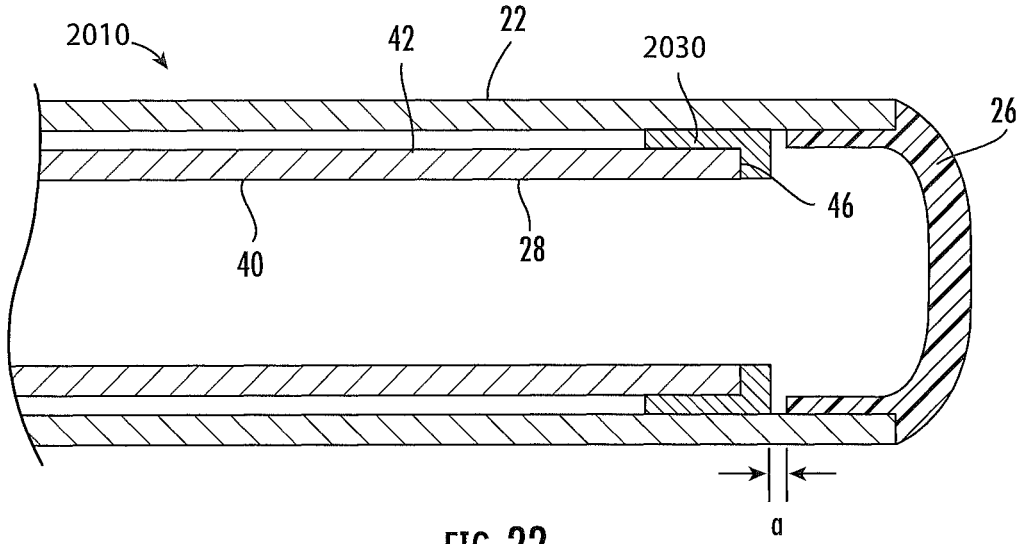
FIG. 22 is a sectional view of another example ball bat take along line 2B-2B of FIG. 1.

FIG. 22 illustrates portions of an example ball bat 2010. Ball bat 2010 is similar to ball bat 10 described above except that in ball bat 2010, the distal end 46 of the tubular insert 28 extends over only a portion of the spacing insert, spacing insert 2030, such that the spacing insert 2030 spaces apart the distal end 46 and adjacent region of the tubular insert 28 from the barrel 22 and the spacing insert 2030 also extends beyond the distal end 46 of the tubular insert 28. The spacing insert 2030 creates the separation S between the outer surface 42 of the tubular insert 28 and the inner surface of the barrel 22. Importantly, neither the tubular insert 28 nor the spacing insert 2030 engage the end cap 26. Similar to other implementations of ball bats described above, the distal end 46 and the spacing insert 2030 are longitudinally spaced from the end cap 26 by a dimension, a, of at least 0.010 inches. In other implementations, the spacing insert 20 30 may abut the interior surface 48 of end cap 26 while remaining unattached to end cap 26, such that the dimension a may be zero. Also similar to the above-described implementations, the cantilevered portion 40 still extends at least 70% of a length of the barrel 22. In such implementations, the insert mounting portion 34 may, in some instances, still be spaced from the distal end of the barrel by no greater than 20% of the total length of the tubular insert 28.

Figure 23:
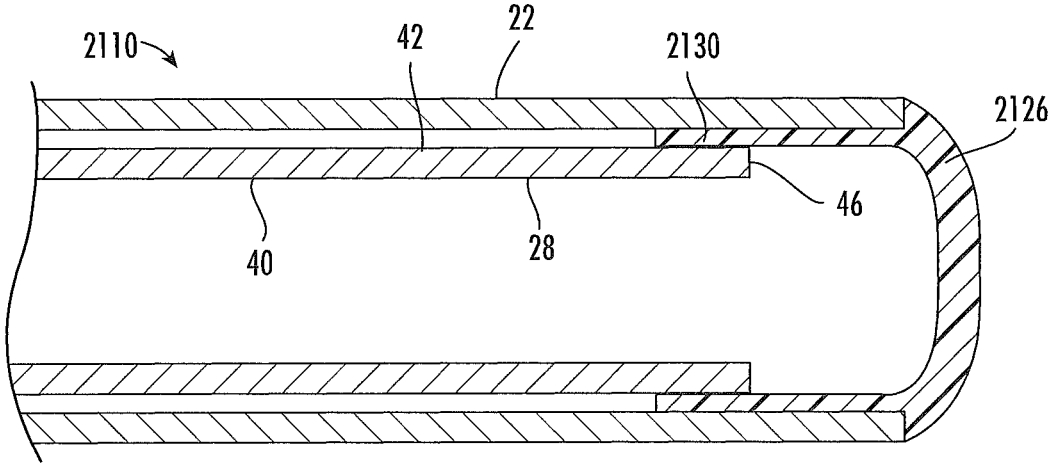
FIG. 23 is a sectional view of another example ball bat take along line 2B-2B of FIG. 1.

FIG. 23 illustrates portions of an example ball bat 2110. Ball bat 2110 is similar to ball bat 10 described above except that in ball bat 2110, the end cap 2126 and the spacing insert 2130 can be combined as one integral component, such that the spacing insert 2130 is also a proximal region of the end cap 2126, and the end cap structure is the distal region of the end cap 2130. The spacing insert 2130 creates the separation S between the outer surface 42 of the tubular insert 28 and the inner surface of the barrel 22. In such an implementation, the cantilevered portion 40 still extends at least 70% of a length of the barrel 22. In such implementations, the insert mounting portion 34 may, in some instances, still be spaced from the distal end of the barrel by no greater than 20% of the total length of the tubular insert 28.

Although the present disclosure has been described with reference to example implementations, workers skilled in the art will recognize that changes may be made in form and detail without departing from the spirit and scope of the claimed subject matter. It is contemplated that one or more features of one or more of the example ball bats described above can be utilized with any of the other examples of ball bats described above. For example, although different example implementations may have been described as including features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A ball bat extending along a longitudinal axis and configured for impacting a ball, the bat comprising:

a handle portion;

an end cap;

a barrel longitudinally extending along the axis from the handle portion to the end cap, the barrel having a distal end and an inner surface, a portion of which proximate the distal end forms an insert mounting portion; and a tubular insert comprising a cantilevered portion having an outer surface separated from the inner surface of the barrel and a single barrel mounting portion, wherein the cantilevered portion is cantilevered from the insert mounting portion independent of the end cap and forms a majority of a length of the tubular insert, the single barrel mounting portion being the only location where the tubular insert engages the barrel, wherein the cantilevered portion of the tubular insert is radially spaced from the barrel by a separation having a thickness of at least 0.002 inches and no greater than 0.250 inches.

2. The ball bat of claim 1, wherein the separation has a thickness of at least 0.005 inches and no greater than 0.080 inches.

3. The ball bat of claim 1, wherein the thickness of the separation varies along the length of cantilevered portion.

4. The ball bat of claim 1, wherein the separation is configured to allow for independent movement between the inner surface of barrel and the outer surface of the tubular insert upon impact with the ball.

5. The ball bat of claim 4, wherein upon impact with the ball, the barrel deflects inwardly at the impact location such that the outer surface of the tubular insert operably engages the inner surface of the barrel.

6. A ball bat extending along a longitudinal axis and configured for impacting a ball, the bat comprising:

a handle portion;

an end cap;

a barrel longitudinally extending along the axis from the handle portion to the end cap, the barrel having a distal end and an inner surface, a portion of which proximate the distal end forms an insert mounting portion; and a tubular insert comprising a cantilevered portion having an outer surface separated from the inner surface of the barrel and a single barrel mounting portion, wherein the cantilevered portion is cantilevered from the insert mounting portion independent of the end cap and forms a majority of a length of the tubular insert, the single barrel mounting portion being the only location where the tubular insert engages the barrel, wherein the tubular insert has a distal end that is longitudinally spaced from the end cap.

7. The ball bat of claim 6, wherein the distal end of the tubular insert is longitudinally spaced from the end cap by at least 0.005 inches and no greater than 0.5 inches.

8. The ball bat of claim 1, wherein the outer surface of the cantilevered portion has a first outer diameter and wherein the tubular insert further is integrally formed as part of a single unitary body with the cantilevered portion, the barrel mounting portion having an outer surface having a second outer diameter greater than the first outer diameter so as to form a spacing interface.

9. The ball bat of claim 8, wherein the barrel mounting portion is secured to the insert mounting portion by at least one of adhesive, serrations, threads, an interference fit or combinations thereof.

10. A ball bat extending along a longitudinal axis and configured for impacting a ball, the bat comprising:

a handle portion;

an end cap;

a barrel longitudinally extending along the axis from the handle portion to the end cap, the barrel having a distal end and an inner surface, a portion of which proximate the distal end forms an insert mounting portion; and a tubular insert comprising a cantilevered portion having an outer surface separated from the inner surface of the barrel and a single barrel mounting portion, wherein the cantilevered portion is cantilevered from the insert mounting portion independent of the end cap and forms a majority of a length of the tubular insert, the single barrel mounting portion being the only location where the tubular insert engages the barrel, wherein the barrel comprises a first shoulder along the inner surface and wherein the tubular insert comprises a second shoulder opposing the first shoulder.

11. The ball bat of claim 10, wherein the barrel comprises a central impact region extending from the insert mounting portion to a proximal end of the barrel and wherein the cantilevered portion extends along an entire length of the central impact region.

12. The ball bat of claim 1, wherein the cantilevered portion extends at least 70% of a length of the barrel.

13. A ball bat extending along a longitudinal axis and configured for impacting a ball, the bat comprising:

a handle portion;

an end cap;

a barrel longitudinally extending along the axis from the handle portion to the end cap, the barrel having a distal end and an inner surface, a portion of which proximate the distal end forms an insert mounting portion; and a tubular insert comprising a cantilevered portion having an outer surface separated from the inner surface of the barrel and a single barrel mounting portion, wherein the cantilevered portion is cantilevered from the insert mounting portion independent of the end cap and forms a majority of a length of the tubular insert, the single barrel mounting portion being the only location where the tubular insert engages the barrel, wherein the tubular insert has a uniform thickness along an entirety of a length of the tubular insert.

14. The ball bat of claim 1, wherein the barrel and the tubular insert are each formed from a fiber composite material.

15. The ball bat of claim 1, wherein the tubular insert is supported by the barrel portion only by the interface between the insert mounting portion of the barrel portion and the single barrel mounting portion of the insert.

* * * * *